US009181653B2

(12) United States Patent
Paltakari et al.

(10) Patent No.: US 9,181,653 B2
(45) Date of Patent: Nov. 10, 2015

(54) METHOD FOR PRODUCING MODIFIED CELLULOSE

(71) Applicant: UPM-KYMMENE OYJ, Helsinki (FI)

(72) Inventors: Jouni Paltakari, Espoo (FI); Janne Laine, Espoo (FI); Monika Österberg, Espoo (FI); Ramjee Subramanian, Espoo (FI); Jan-Erik Teirfolk, Turku (FI)

(73) Assignee: UPM-KYMMENE OYJ, Helsinki (FI)

( * ) Notice: Subject to any disclaimer, the term of this patent is extended or adjusted under 35 U.S.C. 154(b) by 0 days.

(21) Appl. No.: 14/069,171

(22) Filed: Oct. 31, 2013

(65) Prior Publication Data

US 2014/0182797 A1 Jul. 3, 2014

Related U.S. Application Data

(62) Division of application No. 13/147,346, filed as application No. PCT/FI2010/050096 on Feb. 12, 2010.

(30) Foreign Application Priority Data

Feb. 13, 2009 (FI) ..... 20095140

(51) Int. Cl.
*D21C 9/00* (2006.01)
*D21H 11/18* (2006.01)
(Continued)

(52) U.S. Cl.
CPC ..... *D21C 9/007* (2013.01); *D21H 11/18* (2013.01); *D21H 17/18* (2013.01); *D21H 17/24* (2013.01); *D21H 17/25* (2013.01); *Y10T 428/298* (2015.01)

(58) Field of Classification Search
CPC ..... D21H 11/18; D21H 27/002; D21H 11/20; D21H 17/25; D21H 17/24; D21H 11/16; D21H 27/005; C08L 2205/16; D21C 9/001; D21C 9/002; D21B 1/30; D21B 1/04
USPC ..... 162/9, 27, 141, 146, 157.1, 157.6, 158, 162/175–177, 182, 187; 241/20–21, 28
See application file for complete search history.

(56) References Cited

U.S. PATENT DOCUMENTS 4,374,702 A 2/1983 Turbak et al.
4,481,076 A 11/1984 Herrick
(Continued)

FOREIGN PATENT DOCUMENTS

CN 1291246 A 4/2001
CN 1424332 A 6/2003
(Continued)

OTHER PUBLICATIONS

Chauhan et al., "Use of Nanotechnology for High Performance Cellulosic and Papermaking Products" 2012, 46 (5-6), pp. 389-400.*
(Continued)

*Primary Examiner* — Jose Fortuna
(74) *Attorney, Agent, or Firm* — Arent Fox LLP

(57) ABSTRACT

The present invention provides a method for producing modified nanofibrillated cellulose characterized by bringing cellulosic material into a fiber suspension, adsorbing a cellulose derivative or polysaccharide or polysaccharide derivative onto fibers in said fiber suspension under special conditions and subjecting the obtained fiber suspension derivative to mechanical disintegration. A modified nanofibrillated cellulose obtainable by a method of the present invention is provided. Furthermore, the invention relates to the use of said modified nanofibrillated cellulose.

18 Claims, 5 Drawing Sheets

(51) Int. Cl.

| | |
|---|---|
| ***D21H 17/24*** | (2006.01) |
| ***D21H 17/25*** | (2006.01) |
| ***D21H 17/18*** | (2006.01) |

(56) References Cited

U.S. PATENT DOCUMENTS

| | | | | |
|---|---|---|---|---|
| 4,481,077 | A | 11/1984 | Herrick | |
| 5,316,623 | A | 5/1994 | Espy | |
| 5,487,419 | A | 1/1996 | Weibel | |
| 5,601,346 | A | 2/1997 | Lustenberger et al. | |
| 5,964,983 | A | 10/1999 | Dinand et al. | |
| 6,224,663 | B1 | 5/2001 | Cantiani et al. | |
| 6,231,657 | B1 | 5/2001 | Cantiani et al. | |
| 6,312,669 | B1 | 11/2001 | Cantiani et al. | |
| 6,485,767 | B1 | 11/2002 | Cantiani et al. | |
| 6,958,108 | B1 | 10/2005 | Vuorinen | |
| 7,700,764 | B2 | 4/2010 | Heijnesson-Hulten | |
| 8,012,573 | B2 | 9/2011 | Kowata et al. | |
| 8,142,615 | B2 | 3/2012 | Wildlock et al. | |
| 8,388,808 | B2 * | 3/2013 | Heijnesson-Hulten et al. | 162/164.1 |
| 8,585,866 | B2 * | 11/2013 | Mikami et al. | 162/202 |
| 2005/0272836 | A1 | 12/2005 | Yaginuma et al. | |
| 2008/0057307 | A1 | 3/2008 | Koslow et al. | |
| 2009/0305033 | A1 | 12/2009 | Yano et al. | |
| 2010/0024998 | A1 | 2/2010 | Wildlock et al. | |
| 2010/0065236 | A1 | 3/2010 | Henriksson et al. | |
| 2010/0233481 | A1 | 9/2010 | Isogai et al. | |
| 2010/0272938 | A1 | 10/2010 | Mitchell et al. | |
| 2011/0036522 | A1 | 2/2011 | Ankerfors et al. | |
| 2011/0088860 | A1 * | 4/2011 | Heijnesson-Hulten et al. | 162/164.1 |
| 2011/0247772 | A1 | 10/2011 | Kincaid et al. | |
| 2011/0274908 | A1 | 11/2011 | Kowata et al. | |
| 2011/0277947 | A1 | 11/2011 | Hua et al. | |
| 2012/0041183 | A1 | 2/2012 | Hu et al. | |
| 2012/0043039 | A1 | 2/2012 | Paltakari et al. | |
| 2012/0090192 | A1 | 4/2012 | Oevreboe et al. | |
| 2012/0097352 | A1 | 4/2012 | Rasanen et al. | |
| 2012/0132383 | A1 | 5/2012 | Laine et al. | |
| 2012/0227633 | A1 | 9/2012 | Laukkanen et al. | |
| 2012/0227920 | A1 | 9/2012 | Juppo et al. | |
| 2012/0277351 | A1 * | 11/2012 | Yano et al. | 524/35 |
| 2012/0302120 | A1 | 11/2012 | Clark et al. | |
| 2012/0316330 | A1 | 12/2012 | Zhu et al. | |
| 2013/0000855 | A1 | 1/2013 | Nuopponen et al. | |
| 2013/0005869 | A1 | 1/2013 | Yano et al. | |
| 2013/0133848 | A1 * | 5/2013 | Heijnesson-Hulten et al. | 162/141 |
| 2013/0180680 | A1 * | 7/2013 | Axrup et al. | 162/177 |
| 2014/0182797 | A1 * | 7/2014 | Paltakari et al. | 162/72 |
| 2015/0034263 | A1 * | 2/2015 | Nuopponen | 162/57 |
| 2015/0167243 | A1 * | 6/2015 | Bilodeau et al. | 162/57 |

FOREIGN PATENT DOCUMENTS

| | | | |
|---|---|---|---|
| CN | 1668646 | A | 9/2005 |
| EP | 1 553 103 | A1 | 7/2005 |
| EP | 1 839 499 | A1 | 10/2007 |
| EP | 2 236 664 | A1 | 10/2010 |
| JP | H07173332 | A | 7/1995 |
| JP | 2000-503703 | A | 3/2000 |
| JP | 2000-503704 | A | 3/2000 |
| JP | 2001-517609 | A | 10/2001 |
| JP | 2001520180 | A | 10/2001 |
| JP | 2001-520868 | A | 11/2001 |
| JP | 2002526247 | A | 8/2002 |
| JP | 2004-41119 | A | 2/2004 |
| JP | 2004-248536 | A | 9/2004 |
| JP | 2004-283135 | A | 10/2004 |
| JP | 2004305005 | A | 11/2004 |
| JP | 2004313058 | A | 11/2004 |
| JP | 2005095061 | A | 4/2005 |
| JP | 2005118001 | A | 5/2005 |
| JP | 2005171200 | A | 6/2005 |
| JP | 2006008857 | A | 1/2006 |
| JP | 2006290972 | A | 10/2006 |
| JP | 2007082415 | A | 4/2007 |
| JP | 2008-48602 | A | 3/2008 |
| JP | 2008-48604 | A | 3/2008 |
| JP | 2008-50376 | A | 3/2008 |
| JP | 2008-50377 | A | 3/2008 |
| JP | 2008-92914 | A | 4/2008 |
| JP | 2008-118988 | A | 5/2008 |
| JP | 2008106178 | A | 5/2008 |
| JP | 2008206435 | A | 9/2008 |
| JP | 2008220268 | A | 9/2008 |
| JP | 2008-544112 | A | 12/2008 |
| RU | 2256601 | C1 | 7/2005 |
| WO | WO 95/02966 | A1 | 2/1995 |
| WO | WO 99/57370 | A1 | 11/1999 |
| WO | WO 00/47628 | A2 | 8/2000 |
| WO | WO 01/21890 | A1 | 3/2001 |
| WO | WO 01/66600 | A1 | 9/2001 |
| WO | WO 2004/055267 | A1 | 7/2004 |
| WO | WO 2004/055268 | A1 | 7/2004 |
| WO | WO 2007/001229 | A1 | 1/2007 |
| WO | WO 2007/091942 | A1 | 8/2007 |
| WO | WO 2009/126106 | A | 10/2009 |
| WO | WO 2010/092239 | A1 | 8/2010 |
| WO | WO 2010/125247 | A2 | 11/2010 |
| WO | WO 2010/134868 | A1 | 11/2010 |

OTHER PUBLICATIONS

English translation of the Chinese Office Action issued on Jan. 14, 2013, in counterpart Chinese Patent Application No. 201080007763.9 (2 pages only).

International Preliminary Report on Patentability dated Aug. 16, 2011, issued in corresponding International Application No. PCT/FI2010/050096.

Laine, Janne, Tom Lindstrom, Funborg Glad Nordmark and Gunnel Risinger; Nordic Pulp & Paper Research Journal—Nord Pulp Paper Res J Jan. 2000; 15(05):520-526. DOI: 10.3183/NPPRJ-2000-15-05-p520-526.

Translation of Russian Office Action dated Apr. 4, 2014 issued in Russian Patent Application No. 2011136555/05(054401).

Official Action dated Apr. 8, 2014 of the corresponding Japanese Application No. 2011-549619.

* cited by examiner 2a 2b 2c

3a

3b

3c

METHOD FOR PRODUCING MODIFIED CELLULOSE

CROSS-REFERENCE TO RELATED APPLICATION

This application is a Divisional of U.S. application Ser. No. 13/147,346, filed Aug. 1, 2011,which is a National Stage entry of International Application No. PCT/FI2010/050096, filed Feb. 12, 2010, which claims priority to Finnish Patent Application No. 20095140, filed Feb. 13, 2009 the disclosure of the prior applications are incorporated in their entirety by reference.

FIELD OF THE INVENTION

The present invention relates to a method for producing modified nanofibrillated cellulose characterized by steps of preparing a suspension containing fibers from cellulosic material, adsorbing a cellulose derivative or polysaccharide or polysaccharide derivative onto the fibers in said suspension under special conditions and subjecting the fiber suspension comprising said cellulose derivative or polysaccharide or polysaccharide derivative to mechanical disintegration. The invention also relates to modified nanofibrillated cellulose obtainable by a method of the present invention. The invention provides a paper containing the modified nanofibrillated cellulose and method and use thereof. Furthermore, the invention relates to the use of said modified nanofibrillated cellulose in paper, food products, composite materials, concrete, oil drilling products, coatings, cosmetic products and pharmaceutical products. The invention also provides a use of the present method for producing modified nanofibrillated cellulose energy efficiently.

BACKGROUND OF THE INVENTION

Cellulose-based nano-sized fibrils provide new possibilities for producing light and strong materials. For example increasing environmental requirements promote more extensive utilization of new natural fiber based biomaterials in the future. Nanosized materials can provide properties which can not be achieved which larger sized particles. The smaller the particle, the larger the surface area is and more possibilities for desired interactions with other materials exist.

Cellulose fibers (width 30-40 μm, length 2-3 mm) can be dismantled into nanosized structures (width about 5-30 nm, length several μms). Microfibrillated cellulose (MFC) has been produced by combining enzymatic or chemical treatments to mechanical treatments. Microfibrils provide even in minor proportion conventional paper products increased toughness and strength. International patent publication WO 2007/091942 discloses a method for manufacturing microfibrillated cellulose using enzymatic treatment.

Properties of the cellulose fibers used for producing paper can be modified by adding polymers to the fiber suspension. Suitable additive polymers include for example starch-based polymers, such as cationized starch, or synthetic polymers such as polyacryl polymers, polyamineamide-, polyamine- and acrylamino-epichlorohydrine polymers, cellulose derivatives or anionic polymers containing carboxyl groups or carboxylate ions in the form of alkali metals of ammonium salts, for example carboxymethyl polysaccharides, such as carboxymethyl cellulose (CMC). International patent publications WO 01/66600 and WO 00/47628 disclose derivatized microfibrillar polysaccharides, such as cellulose and production methods thereof.

CMC or sodium carboxymethyl cellulose is a water-soluble anionic polymer achieved by introducing carboxymethyl groups along the cellulose chain. The functional properties of CMC depend on the degree of substitution on the cellulose structure (i.e. how many of the hydroxyl groups have taken part in the substitution reaction), and also on the chain length of the cellulose backbone. The degree of substitution (DS) of CMC is usually in the range from 0.6 to 0.95 derivatives per monomer unit.

CMC can be used as an additive during the grinding of paper pulp (B. T. Hofreiter in "Pulp and Paper Chemistry and Chemical Technology", Chapter 14, Volume III, 3rd. edition, New York, 1981; W. F. Reynolds in "Dry strength additives", Atlanta 1980; D. Eklund and T. Lindstrom in "Paper Chemistry—an introduction", Grankulla, Finland 1991; J. C. Roberts in "Paper Chemistry"; Glasgow and London 1991).

CMC has a low affinity for cellulose fibers, since both are anionically charged. CMC can still be attached irreversibly to pulp fibres and it increases the surface charge density of pulp fibres.

U.S. Pat. Nos. 5,061,346 and 5,316,623 disclose the addition of CMC to pulp in paper making processes. Publications WO 2004/055268 and WO 2004/055267 present fiber suspensions comprising cellulose enzyme-treated microfibrillar sulphate pulp (eMFC) and carboxymethyl cellulose (CMC) as raw material for packages and for surface application in paperboard and paper production, respectively.

CMC is used as thickener to modify the rheology. CMC has also been used as a dispersion agent. Furthermore, CMC has been used as binder. U.S. Pat. No. 5,487,419 discloses CMC as dispersion agent. U.S. Pat. No. 6,224,663 discloses use of CMC as an additive in a cellulose composition. Publication WO 95/02966 discloses the use of CMC to modify microcrystalline cellulose and in some cases microfibrillated MCC by mixing the two components and the use of this mixture in food compositions.

CMC sorption is known in the art. U.S. Pat. No. 6,958,108 and international patent publication WO 99/57370 disclose a method for producing a fiber product, wherein alkali soluble CMC is added to the pulp under alkali conditions. International patent publication WO 01/021890 discloses a method for modifying cellulose fibers with a cellulose derivative such as CMC. Publication WO 2009/126106 relates to attachment of amphoteric CMC polymers to cellulose fibres before homogenization.

The following articles by Laine et al. disclose modification of cellulosic fibers with CMC: Nord Pulp Pap Res J, 15:520-526 (2000); Nord Pulp Pap Res J, 17:50-56 (2002); Nord Pulp Pap Res J, 17:57-60 (2002); Nord Pulp Pap Res J, 18:316-325 (2003); Nord Pulp Pap Res J, 18:325-332 (2003).

Despite the ongoing research and development in the manufacturing of microfibrillated cellulose there is still a continuing need in the industry to Improve the processes. One problem is high energy consumption and thus there is a need for an energy efficient method. There is also a need for a process, wherein the properties of paper are improved. The present invention provides a method for overcoming the problems associated with the prior art.

SUMMARY OF THE INVENTION

The present invention relates to a method for producing modified nanofibrillated cellulose. The method comprises preparing a suspension containing fibers from cellulosic material, adsorbing a cellulose derivative or polysaccharide or polysaccharide derivative onto the fibers in said suspension under special conditions and subjecting the fiber suspension comprising said cellulose derivative or polysaccharide or polysaccharide derivative to mechanical disintegration to obtain modified nanofibrillated cellulose modified with said cellulose derivative or polysaccharide or polysaccharide derivative. The present invention also relates to modified nanofibrillated cellulose obtainable by the method of the present invention and characterized by that a diameter of modified nanofibrillated cellulose is less than 1 μm.

A significant advance of the present invention is reduced consumption of refining energy compared to the prior art methods. A novel and efficient method for producing modified nanofibrillated cellulose energy efficiently is thus provided.

Additives such as cellulose derivatives or polysaccharides or polysaccharide derivatives are usually added to already fibrillated material i.e. by addition to suspension after mechanical disintegration.

In the present invention the cellulose derivative or polysaccharide or polysaccharide derivative is added prior and/or during mechanical disintegration. This results in the decreased consumption of energy and better fibrillation. In the present invention a cellulose derivative or polysaccharide or polysaccharide derivative is used in a novel way while adsorbed to cellulosic material under special conditions. Cellulosic material is brought into a fiber suspension and a cellulose derivative or polysaccharide or polysaccharide derivative is adsorbed to said fiber suspension. The fiber suspension containing the adsorbed cellulose derivative or polysaccharide or polysaccharide derivative is then subjected to mechanical disintegration. The cellulose derivative or polysaccharide or polysaccharide derivative is anionic or non-ionic.

The present invention further relates to a paper comprising the modified nanofibrillated cellulose prepared according to the method of the present invention.

One of the advantages of the invention is an improvement of the paper properties.

The present invention further relates to the use of said nanofibrillated cellulose in paper, food products, composite materials, concrete, oil drilling products, coatings, cosmetic products or pharmaceutical products.

The present invention further relates to use of a method for producing nanofibrillated cellulose energy efficiently and use of a method for producing paper with improved properties.

Figure 1:
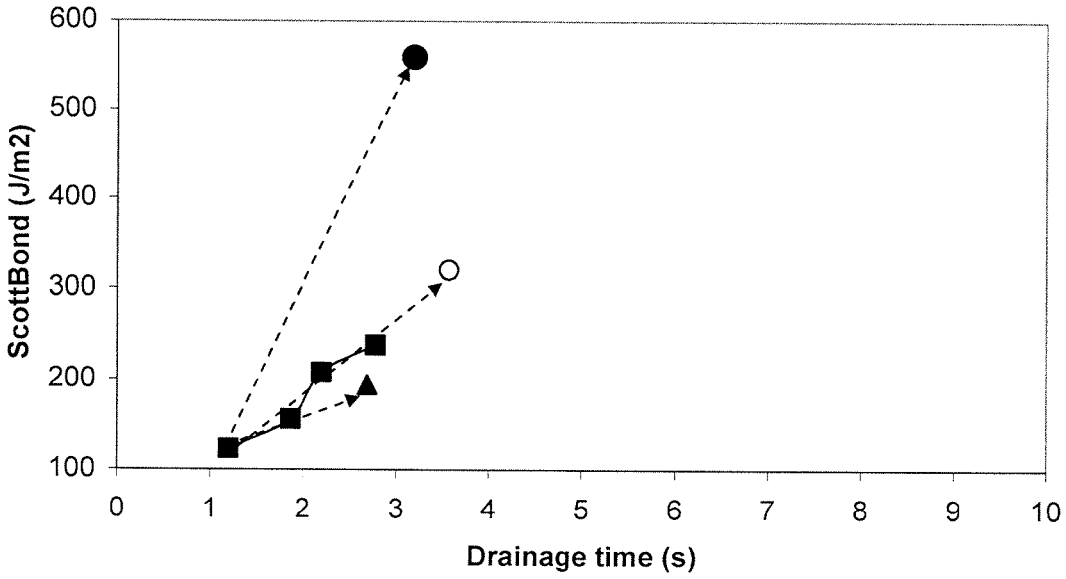
FIG. 1 shows the Scott Bond ($J/m^2$) i.e. the internal strength of a paper sheet, measured on Scott Bond Tester as a function of drainage time, measured using a dynamic drainage analyzer. From this figure it is evident that by adding the nanofibrillated cellulose (NFC) prepared according to this invention (10 min+CS+CMC modified NFC, filled sphere) to only slightly refined pulp almost fivefold increase in internal strength is achieved without severe loss in dewatering efficiency.

Soft wood (pine) pulp was refined for 10 minutes and the pulp was washed to sodium form. A cationic starch (CS; Raisamyl 50021, DS=0.035, Ciba Specialty Chemicals) was used as an additive in some of the cases (10 min+CS+CMC modified NFC, filled sphere; 10 min+CS+unmodified NFC open sphere). The NFC was dispersed with ultrasound microtip sonication prior to use. All experiments were done in a solution of deionised water containing 1 mM $NaHCO_3$ and 9 mM NaCl.

Pulp was first mixed with cationic starch (CS, 25 mg/g dry pulp) for 15 min, then the dispersed nanofibrillated cellulose (NFC, 30 mg/g dry pulp) was added and the is suspension was mixed for another 15 min. In the cases where no CS was used (10 min+unmodified NFC; triangle) only NFC (30 mg/g) was added and the suspension was mixed for 15 min before sheet making. The sheets were prepared in laboratory sheet former (SCAN-C26:76) and dried under restrain. For comparison the effect of refining is shown by the black squares. In this series the pulp has been refined for 10, 15, 20 and 30 minutes, respectively, as shown by black squares. The CMC modified NFC in this example was prepared by sorption of Finnfix VVRM CMC and 3 passes through the friction grinder with addition of the same CMC before the second and third pass. Abbreviations: CS, cationic starch; NFC, nanofibrillated cellulose; CMC, Carboxy methyl cellulose.

Figure 2:
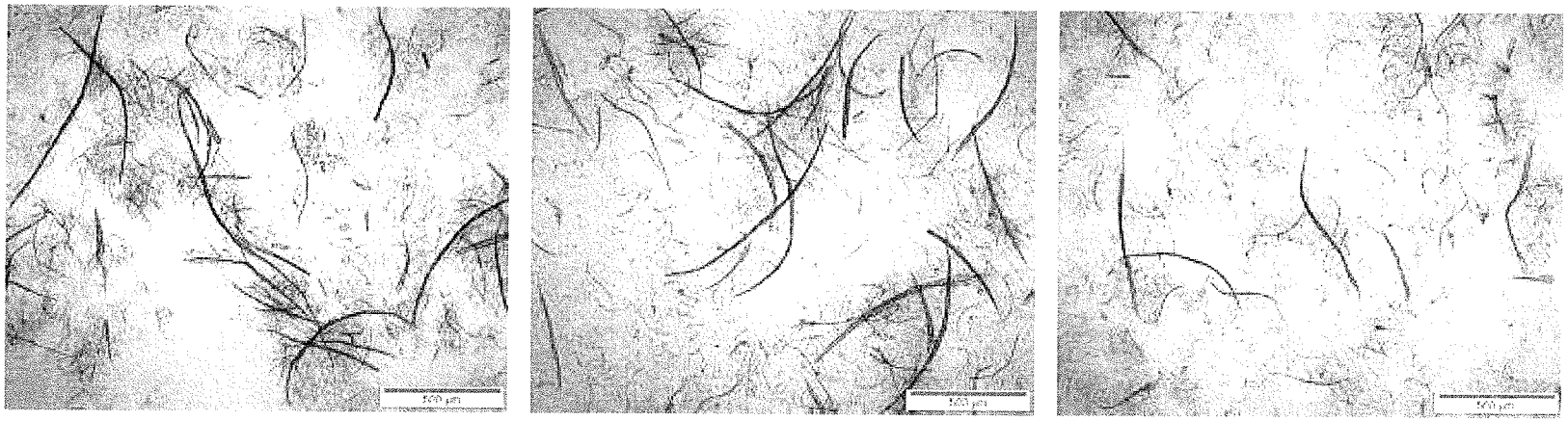

FIG. 2 depicts optical microscopy images of CMC modified nanofibrillated cellulose. CMC (Finnfix WRM, high molecular weight CMC) was added during fibrillation in fluidizer. FIG. 2*a* shows modified nanofibrillated cellulose after 1+1 passes through the fluidizer. FIG. 2*b* shows modified nanofibrillated cellulose after 1+2 passes through the fluidizer. FIG. 2*c* shows modified nanofibrillated cellulose after 1+3 passes through the fluidizer. The decrease in the amount of large particles can be observed.

Figure 3:
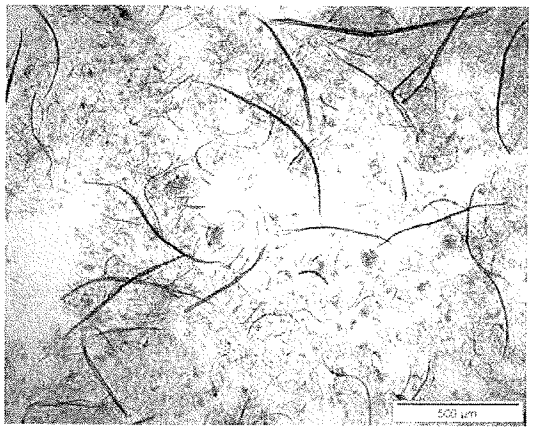
Figure 3:
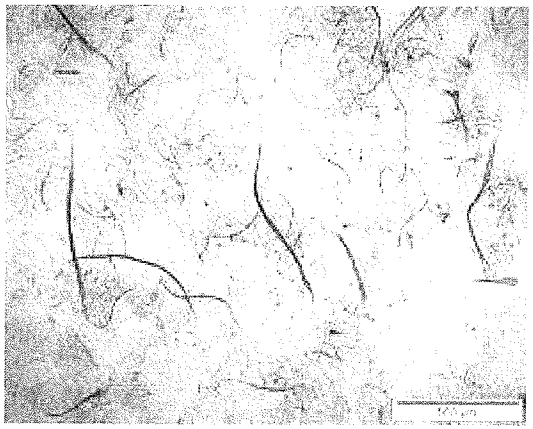
Figure 3:
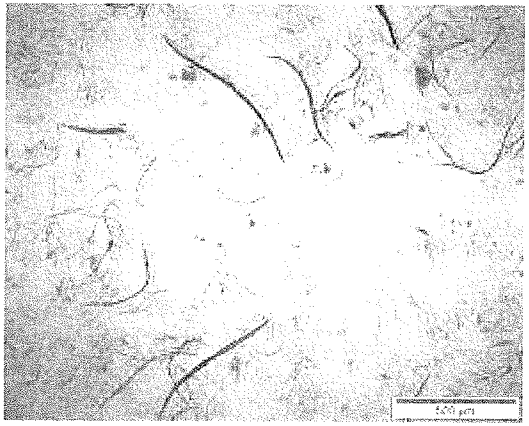

FIG. 3 depicts optical microscopy images of samples after 1+3 passes through the fluidizer. FIG. 3*a* shows the image of unmodified nanofibrillated cellulose (NFC). FIG. 3*b* shows the image of NFC modified according to this invention by addition of 10 mg/g dry pulp Finnfix, WRM high molecular weight CMC before each pass (a total of 40 mg/g after 1+3 passes). FIG. 3*c* shows the image of NFC modified according to this invention by addition of 10 mg/g dry pulp Finnfix, BW low molecular weight CMC before each pass (a total of 40 mg/g after 1+3 passes).

Figure 4A:
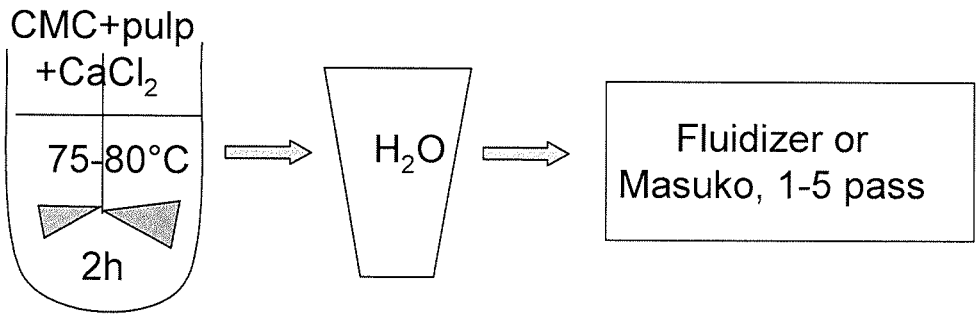
Figure 4B:
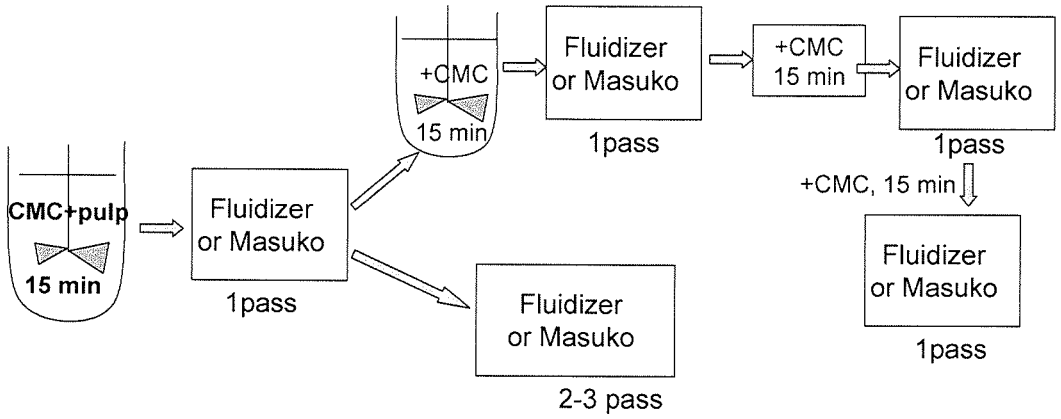

FIG. 4*a* depicts a schematic diagram of CMC pre-sorption onto the fibre prior to mechanical disintegration. FIG. 4*b* depicts a schematic diagram of CMC addition to the pulp suspension prior to and/or during mechanical disintegration. In contrast to the method shown in FIG. 4*a* CMC is allowed to adsorb during the whole disintegration process.

Figure 5:
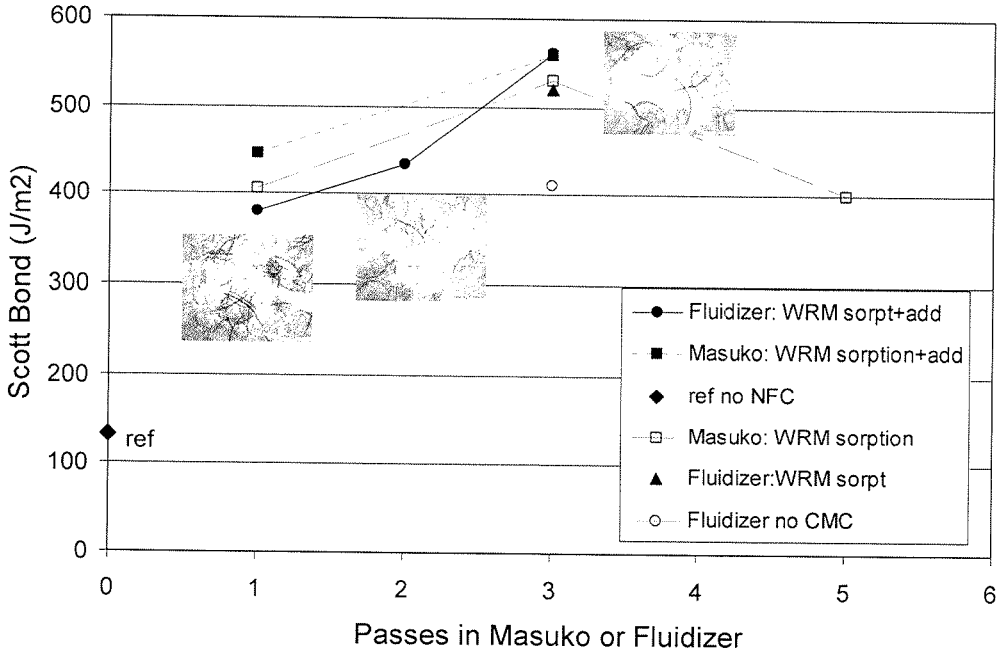

FIG. 5 shows the Scott Bond as a function of passes through Masuko or Fluidizer. The corresponding microscopy images are of the Fluidizer samples after 2, 3 and 4 passes through the fluidizer, respectively.

DETAILED DESCRIPTION OF THE INVENTION

The present invention provides a method for producing modified nanofibrillated cellulose by adsorbing a cellulose derivative or polysaccharide or polysaccharide derivative onto fibers in a fiber suspension under special conditions and subjecting the fiber suspension comprising a cellulose derivative or polysaccharide or polysaccharide derivative to mechanical disintegration. By combining the adsorption of a cellulose derivative or polysaccharide or polysaccharide derivative onto fibers under special conditions and mechanical disintegration the number of passes through a disintegration device needed to refine the pulp is reduced and the energy demanded is decreased. Special conditions according to the present invention include temperature, presence of monovalent or polyvalent cations, adsorption time and/or mixing. It has surprisingly been found that the amount of refining energy needed in the process is decreased. The present invention provides significant advances compared to the prior art by decreasing the energy consumption during fibrillation. The modification of nanofibrillated cellulose with a cellulose derivative or polysaccharide or polysaccharide derivative prior to and/or during the mechanical disintegration surprisingly increases the processing efficiency.

Furthermore, the modified nanofibrillated cellulose improves the paper properties more than unmodified nanofibrillated cellulose. None of the prior art methods results in the similar strength properties for paper when compared to modified nanofibrillated cellulose according to the present invention. Nanofibrillated cellulose modified with a cellulose derivative or polysaccharide or polysaccharide derivative contains up to five times more nanofibrils than the unmodified nanocellulose prepared from the same pulp. The strength of paper produced from the modified nanofibrillated cellulose using the special conditions of the present invention is already after the initial pass through the friction grinder considerably increased as compared to unmodified fibrils. Thus, mechanical treatment to obtain modified nanofibrillated cellulose can be reduced to one fifth, while still achieving considerably improved paper qualities. Nanofibrillated cellulose together with a modification by a cellulose derivative or polysaccharide or polysaccharide derivative under special conditions provides a synergistic effect, which can be utilized in paper produced from said modified nanocellulose.

Unless otherwise specified, the terms, which are used in the specification and claims, have the meanings commonly used in the pulp and paper industry. Specifically, the following terms have the meanings indicated below:

The term "nanofibrillated cellulose" or NFC" refers to very refined cellulose where most of the fibrils have been fully liberated from the fibers and occur as individual threads, which are 5 nm-1 μm thick and several μms long. Conventionally the fibrils having a diameter of less than 1 μm are called nanofibrils and fibrils having a diameter of more than 1 μm and length of several micrometers are called microfibrils.

The term "mechanical disintegration" or "fibrillation" or "grinding" in the present invention relates to producing nanofibrillated cellulose from larger fiber material. Mechanical disintegration includes also for example refining, beating and homogenization. Mechanical disintegration can be carried out with suitable equipment such as a refiner, grinder, homogenizer, colloider, friction grinder, fluidizer such as microfluidizer, macrofluidizer or fluidizer-type homogenizer.

The term "cellulosic material" refers to nonwoody and wood cellulosic materials used. As cellulosic material for the method and process of the present invention almost any kind of cellulosic raw materials is suitable, as described below.

The term "special conditions" in the present invention refers to a specified temperature, presence of monovalent or polyvalent cations, adsorption time and/or mixing which are defined according to the present invention.

The term "chemical pulp" refers to all types of chemical wood-based pulps, such as bleached, half-bleached and unbleached sulphite, sulphate and soda pulps, kraft pulps together with unbleached, half-bleached and bleached chemical pulps and mixtures thereof.

The term "paper", as used herein, includes not only paper and production thereof, but also other web-like products, such as nonwoven, board and paperboard, and the production thereof.

The present invention provides a method for producing modified nanofibrillated cellulose wherein the method comprises steps of preparing a suspension containing fibers from cellulosic material, adsorbing a cellulose derivative or polysaccharide or polysaccharide derivative onto the fibers in said suspension under specified conditions and subjecting the fiber suspension comprising said cellulose derivative or polysaccharide or polysaccharide derivative to mechanical disintegration to obtain modified nanofibrillated cellulose modified with said cellulose derivative or polysaccharide or polysaccharide derivative.

According to an embodiment of the present invention a cellulose derivative or polysaccharide or polysaccharide derivative is adsorbed onto the fibers either prior to mechanical disintegration (sorption) or by adding a cellulose derivative or polysaccharide or polysaccharide derivative during the mechanical disintegration (addition) under special conditions. In still another embodiment of the invention the cellulose derivative or polysaccharide or polysaccharide derivative is adsorbed onto the fibers both prior to and during the mechanical disintegration.

In a preferred embodiment of the invention as cellulosic material for the method of the present invention almost any kind of cellulosic raw materials is suitable. The cellulosic material which is used in the present invention includes pulp such as a chemical pulp, mechanical pulp, thermo mechanical pulp (TMP) or chemi-thermo mechanical pulp (CTMB) produced from wood, non-wood material or recycled fibers. Wood can be from softwood tree such as spruce, pine, fir, larch, douglas-fir or hemlock, or from hardwood tree such as birch, aspen, poplar, alder, eucalyptus or acacia, or from a mixture of softwoods and hardwoods. Non-wood material can be from agricultural residues, grasses or other plant substances such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed. Non-wood material can also be from algae or fungi or of bacterial origin.

In a preferred embodiment of the invention as a cellulose derivative for the purposes of the present invention almost any kind of cellulose derivative is suitable. A cellulose derivative can be carboxymethyl cellulose, methyl cellulose, hydroxyethyl cellulose, hydroxypropyl cellulose, ethylhydroxyethyl cellulose, carboxymethylcellulose, carboxymethylhydroxyethyl cellulose, hydroxypropylhydroxyethyl cellulose, methylhydroxypropyl cellulose, methylhydroxyethyl cellulose, carboxymethylmethyl cellulose, or hydrophobically modified variants thereof, or cellulose acetate, cellulose sulfate, cellulose phosphate, cellulose phosphonate, cellulose vinyl sulfate, or nitrocellulose or other derivatives known by the person skilled in the art can be applied. The present invention is exemplified by using carboxymethyl cellulose (CMC) for producing modified nanofibrillated cellulose. Preferably anionic CMC is used. Even though CMC represents a preferred embodiment, it should be noted, that other cellulose derivatives known by the person skilled in the art can be used.

In a preferred embodiment of the invention a polysaccharide or polysaccharide derivative can be selected from guar gums, chitins, chitosans, galactans, glucans, xantan gums, mannans or dextrins, which are given here by the way of examples. It should be noted, that other polysaccharides or polysaccharide derivatives known by the person skilled in the art can be used.

The amount of added cellulose derivative or polysaccharide or polysaccharide derivative is at least 5 mg/g of fiber suspension, preferably from 10 to 50 mg/g of fiber suspension, more preferably about 15 mg/g, 20 mg/g, 25 mg/g, 30 mg/g, 35 mg/g or 40 mg/g of fiber suspension, the upper limit being 1000 mg/g of fiber suspension, preferably the upper limit is 100 mg/g of fiber suspension.

In an embodiment where CMC is used as the cellulose derivative, different commercially available CMC grades having a suitable degree of substitution and molar mass can be used for carrying out the invention. Typically high molecular weight CMC has suitable characteristics for mechanical disintegration or fibrillation and typically low molecular weight CMC can penetrate the fiber wall, which also increases the amount of adsorbed CMC.

In a preferred embodiment of the invention a cellulose derivative or polysaccharide or polysaccharide derivative is adsorbed onto the fibers at a temperature of at least 5° C., preferably at a temperature of at least 20° C., the upper limit being 180° C. In a more preferred embodiment of the invention temperature is from 75° C. to 80° C.

In a preferred embodiment of the invention a cellulose derivative or polysaccharide or polysaccharide derivative is adsorbed onto the fibers for at least 1 minute, preferably for at least 1 hour, preferably for 2 hours. Preferably the adsorption is aided by sufficient mixing.

In a preferred embodiment of the present invention the absorption is made in the presence of monovalent or polyvalent cations such as aluminium, calcium and/or sodium salts containing $Al^{3+}$, $Ca^{2+}$ and/or $Na^{+}$, respectively, preferably for example $CaCl_2$. High valencies are advantageous for the adsorption. Generally a higher concentration of electrolyte and a higher valence of the cation increase the affinity of an anionic cellulose derivative, such as CMC, to the pulp. Generally, however, an optimum exists. The preferred concentration interval for salts with divalent cations such as $CaCl_2$ is between 0 and 1 M, preferably about 0.05 M.

In a preferred embodiment of the invention the pH value of the fiber suspension is at least pH 2, preferably from about pH 7.5 to 8, the upper limit being pH 12. A suitable base or acid is used for setting the pH. The pH value is dependent on the origin of the fibers in the mass.

The sorption at specified conditions ensures that a cellulose derivative or polysaccharide or polysaccharide derivative is irreversibly attached to the pulp prior to disintegration. The addition at low temperature during disintegration does not facilitate sorption but indicates the effect of a cellulose derivative or polysaccharide or polysaccharide derivative in solution on fibrillation efficiency.

The present invention comprises a step of mechanical disintegration. In a preferred embodiment of the invention the mechanical disintegration is carried out with a refiner, grinder, homogenizer, colloider such as a supermass colloider, friction grinder, fluidizer such as microfluidizer, macrofluidizer or any fluidizer-type homogenizer known by the person skilled in the art without, however, not limiting to these examples. Typically the fiber suspension is passed through mechanical disintegration at least once, preferably 1, 2, 3, 4 or 5 times.

This enables the reduction of mechanical treatment by up to one fifth, while at the same time considerable improvement for example in paper quality is achieved. It is shown in the Examples that the energy consumption during friction grinding of pulp modified with a cellulose derivative, such as CMC, is lower compared to friction grinding of same pulp without a cellulose derivative, such as CMC adsorbed. The energy consumption of producing the modified nanocellulose of the present invention is lower compared to unmodified pulp. The energy needed to obtain roughly the same amount of nanofibrillated material is halved.

In a preferred embodiment of the invention the fiber suspension containing the cellulose derivative or polysaccharide or polysaccharide derivative is redispersed in water to a concentration of at least 0.1%, preferably at least 1%, more preferably at least 2%, 3%, 4% or 5%, up to 10% prior to mechanical disintegration. In a preferred embodiment using the friction grinder for the mechanical disintegration the fiber suspension containing the cellulose derivative or polysaccharide or polysaccharide derivative is redispersed in water to 3% consistency. Preferably 1-5 passes are run.

The present invention also relates to nanofibrillated cellulose prepared according to the method of any of the claims.

In nanosized structure the surface area of cellulose is maximized and the structure has more chemically functional groups than cellulose in general. This means that nanocellulose fibers attach strongly to surrounding substances. This provides the paper produced from the nanocellulose with good strength properties. Using the modified nanocellulose according to the present invention even higher strength properties than with unmodified nanocellulose are obtained.

The present invention relates to the use of modified nanofibrillated cellulose according to the present invention in paper. The present invention also relates to a paper containing the modified nanofibrillated cellulose of the present invention. In a preferred embodiment the amount of modified nanofibrillated cellulose is at least 0.2%, preferably at least 1%, 2%, 3%, 4% or 5%, up to 20% by weight of the paper. Other ingredients in paper are such that are known to the person skilled in the art. The paper is prepared using the standard methods used in the field and known by the person skilled in the art. The technical paper properties of both fibril sheets of the present invention and paper sheets containing modified nanofibrillated cellulose of the present invention are tested using standard methods known by the person skilled in the art.

Adsorbed cellulose derivative or polysaccharide or polysaccharide derivative of the present invention is used in a novel way. Combining the adsorption of the cellulose derivative or polysaccharide or polysaccharide derivative and mechanical disintegration provides novel and surprising advantages. It is noted that in the present process, energy savings are achieved. Another advantage of the modification is the new properties of the modified fibrils that can be used for example to improve the properties of paper. The strength of the paper produced from the modified nanofibrillated cellulose of the present invention is already after the initial pass through the refiner considerably increased as compared to unmodified fibrils. Thus, mechanical treatment can be reduced to up to one fifth, while at the same time considerable improvement for example in paper quality is achieved.

The efficiency of the mechanical disintegration or fibrillation is determined by gravimetrically measuring the amount of nano-size particles after each pass through the homogenizing device.

Application areas for the modified nanofibrillated cellulose of the present invention include, but are not restricted to paper, food products, composite materials, concrete, oil drilling products, coatings, cosmetic products and pharmaceutical products. Other possible application areas of the modified nanocellulose of the present invention include for example the use as a thickener, use in composites for vehicles, consumables and furniture, in new materials for electronics and use in moldable light weight and high strength materials.

The following example is given to further illustrate the invention and is not intended to limit the scope thereof. Based on the above description, a person skilled in the art will be able to modify the invention in many ways.

EXAMPLES

Example 1

Materials

Pulp

Bleached, never-dried kraft birch pulps provided by UPM-Kymmene Oyj were used.

CMC

Two different CMC grades were used: the high molecular weight Finnfix WRM or low molecular weight Finnfix BW (DS 0.52-0.51) (CP Kelco, Äänekoski, Finland).

CMC adsorption was carried out with two strategies: either treating the pulp prior to fibrillation with CMC in specific conditions (sorption) or adding the CMC during the fibrillation (addition). The third strategy was to adsorb CMC both prior to fibrillation and during fibrillation.

CMC Sorption

The pulp (never dried hardwood) was first washed with deionised water prior to sorption. A slurry with pulp consistency of 30 g/l containing 0.05 M $CaCl_2$ and 0.01 M $NaHCO_3$ was prepared and heated to 75-80° C. 20 mg carboxymethyl cellulose (CMC) was added per gram of pulp (o.d). The pH was adjusted to pH 7.5-8 with 1M NaOH. The slurry was mixed for 2 h at 75-80° C. After sorption the pulp was washed with deionised water, excess water was removed by filtration and the moist pulp cakes were stored in cold room until fibrillation. Batches corresponding to about 20-25 l of 3% CMC sorbed pulp were prepared for fibrillation with friction grinder and batches of about 5 l of 3% CMC sorbed pulp were prepared for fluidizer runs. Sorption is presented in FIG. 4*a*.

CMC Addition

The CMC was dissolved carefully the day before fibrillation into 2% consistency. After dispersing the pulp the addition was done before each pass by adding the CMC solution calculated as 10 mg per dry gram of fibre for one pass. One to four additions corresponding to total additions of 10-40 mg/g were performed. Between the additions the slurry was mixed 15 minutes without heating. In this case the cellulose derivative adsorption was going on during fibrillation.

Fibrillation

Fibrillation was done with either friction grinder (Masuko Supermass colloider, Masuko Sangyo, Japan) or a laboratory scale fluidizer (Microfluidics M110Y, Microfluidics Corp., USA).

Friction Grinding

In friction grinding the CMC sorbed pulp was redispersed in water to 3% consistency using the grinder with 200 μm gap. Subsequently 1 to 5 passes were run through the friction grinder with a gap of roughly 100-160 μm and power around 3 kW and samples were taken after each pass. In the cases where CMC was also added during fibrillation, the slurry was heated to 60-80° C. for 30 min and mixed for 10 min after CMC addition prior to passing through the colloider.

The following experiments were carried out with friction grinder:

1. Reference, unmodified pulp was passed five times through the friction grinder.
2. High molecular weight CMC (WRM) was sorbed onto pulp, the pulp was washed prior to refining and one to five passes were run through the friction grinder.
3. High molecular weight CMC (WRM) was sorbed onto pulp, the pulp was washed prior to refining. 20 mg/g CMC (WRM) was added to suspension (adsorption) before each pass through the friction grinder. The pulp was run one to three times through the refiner.
4. Low molecular weight CMC (BW) was sorbed to the pulp and the pulp was washed prior to refining, one to five passes were run through the friction grinder.

The concentration of nanofibrils in each of the above listed experiments are presented in the upper part of Table 2, "Masuko Supermass Colloider".

Fluidizer

In the experiments carried out with the fluidizer the well beaten pulp (hardwood pulp) was diluted to 2% consistency and pre-dispersed with a Polytron mixer before first run through the fluidizer. The sample was first passed through the wider chamber pair with diameters of 400 and 200 μm at 950 bar and then 1 to 3 times through the smaller chamber pair with diameters of 200 and 100 μm at 1350 bar.

The following experiments were carried out with a fluidizer:

1. Reference: unmodified pulp—only fibrillation.
2. Presorption of CMC (high molecular weight, WRM or low molecular weight, BW) prior to fibrillation
3. Presorption of CMC (high molecular weight, WRM or low molecular weight, BW) prior to fibrillation+addition (adsorption) of CMC during fibrillation.
4. Addition (adsorption) of CMC during fibrillation only (WRM or BW).

The concentrations of nanofibrils in each of the above listed experiments are presented In the lower part of Table 2, "Microfluidics fluidizer".

Amount of Nanosized Material

The proportion of nanosized material in the nanofibrillated cellulose (NFC) was estimated by centrifugation. The more there were unsettled fibrils in the supernatant after centrifugation the more efficient the fibrillation had been. Solids content was determined gravimetrically after drying the samples before and after drying them in oven (105° C.). Based on the value, the samples are diluted into constant (ca. 1.7 g/ml) consistency and dispersed with ultrasound microtip (Branson Digital Sonifier D-450) for 10 min, 25% amplitude setting. After sonification, samples are centrifuged (Beckman Coulter L-90K) for 45 min at 10 000 G. From clear supernatant, 5 ml is carefully taken with a pipette. Two parallel measurements (10 ml) are combined for gravimetric analysis and results are given as an average value for two measurements.

Optical Microscopy Imaging

Fibrous material was stained with 1% Congo red (Merck L431640) in order to improve contrast in light microscopy. Staining liquid was centrifuged (13 00 rpm, 2 min) prior to use to remove insoluble material. For microscopical examination a fibre sample (150 μl) was mixed with Congo red solution at a ratio of 1:1 in an eppendorf tube and about 100 μl of stained fibre slurry was spread with 50 μl of distilled water on microscope slide and covered with a cover slip. The samples were examined using bright field settings under Olympus BX61 microscope equipped with ColorView 12 camera (Olympus). Images were taken with magnifications of 40× and 100× using Analysis Pro 3.1 image processing program (Soft Imaging System GmbH).

Preparation of Fibril Sheets

To demonstrate the efficiency of the present invention sheets containing 85% NFC and 15% unrefined soft wood pulp were prepared according to the standard method using a normal laboratory sheet former (SCAN-C26:76).

Preparation of Paper Sheets with Fibrils as Additives

Softwood pulp was refined for 10 minutes, and the pulp was washed to sodium form. A cationic starch (Raisamyl 50021, DS=0.035, Ciba Specialty Chemicals) was used as an additive. A 2 g/l starch stock solution was prepared fresh every day. The NFC was dispersed with ultrasound microtip sonication prior to use. All experiments were done in a solution of deionised water containing 1 mM $NaHCO_3$ and 9 mM NaCl.

Pulp was first mixed with cationic starch (CS) for 15 min and then the dispersed nanofibrillated cellulose (NFC) was added and the suspension was mixed for another 15 min. The sheets were prepared in laboratory sheet former (SCAN-C26:76) and dried under restrain.

The paper technical properties of both fibril sheets and paper sheets containing modified NFC were tested using standard methods.

Results

Energy Consumption During Production

The energy consumption during friction grinding of CMC sorbed pulp is illustrated in Table 1. Furthermore, average solids content after fibrillation and estimated amount of nanosized material are presented.

TABLE 1

Energy consumption for the fibrillation of pulp after CMC sorption using friction grinder.

| Sample | Passes | Cumulative total refining energy (MW * h/t) | Average solids content [%] | Nanomaterial (upper phase) [g/l] |
|---|---|---|---|---|
| Reference | 1 | 1.84 | | Too low to determine |
| Reference | 3 | 6.63 | | Too low to determine |
| Reference | 5 | 12.75 | | 0.099 |
| WRM sorption | 1 | 1.59 | 2.74 | 0.164 |
| WRM sorption | 2 | 3.16 | 2.44 | 0.110 |
| WRM sorption | 3 | 5.30 | 2.04 | 0.117 |
| WRM sorption | 4 | 7.95 | | Not determined |
| WRM sorption | 5 | 11.06 | 1.75 | 0.110 |

Effect of CMC Modification on Amount of Nanosized Material

TABLE 2

Concentration of nanofibrils in upper phase after centrifugation.

| sample ID | Nano-material conc (g/l) |
|---|---|
| Masuko supermass colloider | |
| unmodified hardwood, 5 pass | 0.099 |
| CMC (WRM) sorption only prior to fibrillation, 1 pass | 0.16 |
| CMC (WRM) sorption only prior to fibrillation, 3 pass | 0.12 |
| CMC (WRM) sorption only prior to fibrillation, 5 pass | 0.11 |
| CMC (WRM) sorption + addition during fibrillation, 2 pass | 0.18 |
| CMC (WRM) sorption + addition during fibrillation, 3 pass | 0.17 |
| CMC (BW) sorption only prior to fibrillation, 1 pass | 0.015 |
| CMC (BW) sorption only prior to fibrillation, 3 pass | not determined |
| CMC (BW) sorption only prior to fibrillation, 5 pass | 0.035 |
| Microfluidics Fluidizer | |
| Unmodified hard wood, 1 + 1 pass | 0.339 |
| Unmodified hard wood, 1 + 2 pass | 0.348 |
| Unmodified hard wood, 1 + 3 pass | 0.452 |
| CMC (BW) sorption only prior to fibrillation, 1 + 1 pass | 0.154 |
| CMC (BW) sorption only prior to fibrillation, 1 + 2 pass | 0.169 |
| CMC (BW) sorption only prior to fibrillation, 1 + 3 pass | 0.218 |
| CMC (BW) addition during fibrillation, 1 + 1 pass | 0.322 |
| CMC (BW) addition during fibrillation, 1 + 2 pass | 0.343 |
| CMC (BW) addition during fibrillation, 1 + 3 pass | 0.415 |
| CMC (BW) sorption + addition during fibrillation, 1 + 1 pass | 0.218 |

TABLE 2-continued

Concentration of nanofibrils in upper phase after centrifugation.

| sample ID | Nano-material conc (g/l) |
|---|---|
| CMC (BW) sorption + addition during fibrillation, 1 + 2 pass | 0.290 |
| CMC (BW) sorption + addition during fibrillation, 1 + 3 pass | 0.196 |
| CMC (WRM) sorption only prior to fibrillation, 1 + 1 pass | 0.129 |
| CMC (WRM) sorption only prior to fibrillation, 1 + 2 pass | 0.124 |
| CMC (WRM) sorption only prior to fibrillation, 1 + 3 pass | 0.123 |
| CMC (WRM) addition during fibrillation, 1 + 1 pass | 0.418 |
| CMC (WRM) addition during fibrillation, 1 + 2 pass | 0.407 |
| CMC (WRM) addition during fibrillation, 1 + 3 pass | 0.492 |
| CMC (WRM) sorption + addition during fibrillation, 1 + 1 pass | 0.112 |
| CMC (WRM) sorption + addition during fibrillation, 1 + 2 pass | 0.184 |
| CMC (WRM) sorption + addition during fibrillation, 1 + 3 pass | 0.179 |

Abbreviations: CMC, carboxymethyl cellulose;

BW, low molecular weight CMC (Finnfix BW, CP Kelco, Äänekoski, Finland, DS 0.51);

WRM, high molecular weight CMC (Finnfix WRM, CP Kelco, Äänekoski, Finland)

CMC sorption increases the efficiency of the fibrillation (Table 2). Tests using friction grinding indicates that sorption prior to fibrillation in combination with addition during fibrillation gives the highest concentration of fibrils in upper phase after centrifugation. In these cases the total amount of CMC used is also highest, since 20 mg/g was added three times i.e. in total of 60 mg.

However, when fluidizer was used an effective way was to add CMC only during the disintegration.

It was thus observed that the upper phase of the CMC modified nanofibrillated cellulose sample contained five times more nanofibrils than the unmodified nanofibrillated cellulose prepared from the same mass.

Effect of CMC Modification on Strength of Test Sheets

The potential of the modified nanofibrillated cellulose (NFC) as a strength additive is illustrated below. In Table 3 the paper properties of test sheets containing 85% NFC and 15% long fibers are compared. A clear increase in paper strength was observed using the modified NFC as compared to unmodified NFC (reference hardwood). Noteworthy is that the density of the paper produced using modified NFC did not increase although the tensile strength was clearly higher than for unmodified NFC. Satisfying results were obtained already after 1 pass through the friction grinder (Masuko colloider).

TABLE 3

NFC Paper Sheet Characteristics.

| | TestPoint | Grammage g/m$^2$ | Apparent density kg/m$^3$ | Tensile strength kNm/kg | Tear Index Jm/kg | Bending stiffness mNm |
|---|---|---|---|---|---|---|
| CMC-treated | WRM sorpt. 1 p | 66.1 | 991 | 93.17 | 4.51 | 0.104 |
| | WRM sorpt. 3 p | 66.2 | 999 | 84.40 | 3.29 | 0.112 |
| | WRM sorpt. 5 p | 66.5 | 987 | 84.89 | 2.99 | 0.126 |
| | BW sorpt. 1 p | 66.2 | 991 | 86.11 | 3.69 | 0.115 |
| | BW sorpt. 2 p | 66.1 | 1000 | 88.04 | 3.20 | 0.107 |
| | BW sorpt. 3 p | 67 | 1030 | 84.89 | 2.70 | 0.125 |
| Ref. | hardwood 5 p | 67.4 | 1010 | 64.84 | 3.75 | 0.089 |

Abbreviations:

WRM sorpt., nanofibril sample modified with high molecular weight CMC (WRM);

BW sorpt., nanofibril sample modified with low molecular weight CMC (BW);

1 p, 2 p, 3 p and 5 p, the amount of the passes through the refiner (refining cycles);

Ref., hardwood 5 p, the corresponding unmodified fiber suspension from hardwood passed five times through the friction grinder.

It was found that the strength of the paper produced from the modified NFC already after the initial pass through the refiner, was considerably increased as compared to unmodified fibrils. Thus, mechanical treatment can be reduced to one fifth, while still achieving considerably improved paper qualities (Table 3).

The effect of NFC on sheet properties was also studied using NFC as an additive. The results are shown in Table 4 and in FIG. 1. In these experiments cationic starch (CS, 25 mg/g) was added to fractionated softwood pulp and adsorbed for 15 minutes, whereupon either unmodified or modified NFC was added (30 mg/g) and adsorbed for 15 minutes and sheets were made. Scott Bond is a measure of the internal strength of the sheet, measured on Scott Bond Tester, expressed in J/m$^2$. In Table 4 the paper properties achieved using NFC prepared according to the present method using Masuko Mass colloider are shown.

TABLE 4

Paper Technical paper properties of sheets made from pulp, cationic starch (CS) and nanofibrillated cellulose (NFC) at constant ionic strength, pH and after fines have been removed. NFC was modified using friction grinder (Masuko super colloider). Reference sample contained pulp only or pulp and cationic starch.

| Sample | Passes | NFC Tensile index (Nm/g) | CS + NFC Tensile index (Nm/g) | NFC Scott Bond (J/m2) | CS + NFC Scott Bond (J/m2) |
|---|---|---|---|---|---|
| Reference | 5 | 64.6 | 83.37 | 194 | 320 |
| CMC sorption (WRM) | 1 | 70.15 | 90.2 | 180 | 405 |
| CMC sorption (WRM) | 3 | 68.97 | 84.16 | 193 | 531 |
| CMC sorption (WRM) | 5 | 68.26 | 89.49 | 204 | 400 |
| CMC sorption + addition (WRM) | 1 | 67.77 | 85.08 | 211 | 446 |
| CMC sorption + addition (WRM) | 3 | 66.42 | 86.76 | 190 | 559 |

Abbreviations:

CS, cationic starch; NFC, nanofibrillated cellulose; CMC, carboxymethyl cellulose; WRM, high molecular weight CMC; BW, low molecular weight CMC The Efficiency of the Fibrillation The efficiency of the fibrillation made according to this invention is illustrated by optical microscopy images in FIGS. 2 and 3. The scale bars in the figures are 500 μm. The decrease in the amount of dark thick fibers shows the efficiency of fibrillation. The finest nanosized material is obviously not visible in optical microscopy.

CMC (Finnfix WRM, high molecular weight CMC) was added during fibrillation in fluidizer. In FIG. 2 the samples after different amount of passes, 1+1, 1+2 and 1+3 passes, respectively, through the fluidizer are compared, (FIGS. 2*a*, 2*b* and 2*c*). The decrease in the amount of large particles can be observed.

In FIG. 3 CMC-modified samples (FIGS. 3*b* and 3*c*) are compared to a sample of unmodified nanofibrillated cellulose (FIG. 3*a*) after 1+3 passes through the fluidizer. NFC was modified according to this invention by addition of 10 mg/g dry pulp Finnfix, WRM high molecular weight CMC before each pass (a total of 40 mg/g after 1+3 passes) (FIG. 3*b*). The image of NFC modified according to this invention by addition of 10 mg/g dry pulp Finnfix, BW low molecular weight CMC before each pass (a total of 40 mg/g after 1+3 passes) is shown in FIG. 3*c*. Clearly there are much less large particles left in the samples modified according to this invention than in an unmodified sample.

Example 2

Materials

Pulps

Bleached softwood kraft pulp made from Scots Pine (*Pinus sylvestris*) was aquired from UPM-Kymmene Oyj, Kaukas pulp mill in air dry sheets. The dry pulp samples were swollen in deionized water and beaten in a Valley beater according to standard SCAN-C 25:76. Unless otherwise stated the beating time was 10 min. Thereafter any remaining metal ions were removed by acid treatment, and the fibres were washed into their Na-form according to method described by Swerin et al. (1990). Finally the samples were dewatered and stored in a refrigerator at ca. 20% consistency. Prior to use the samples were diluted to desired consistency and cold disintegrated according to standard SCAN-C 18:65. The salt concentration of the suspensions was adjusted to 9 mM NaCl and 1 mM $NaHCO_3$, and the pH was adjusted to 8.0.

Polyelectrolytes

Two different CMC (carboxymethyl cellulose) grades from CP Kelco Oy (Äänekoski, Finland) were used for preparation of modified NFC. They are hereafter referred to as WRM (high molecular weight) CMC and BW (low molecular weight) CMC.

In sheet preparation and dewatering experiments cationic starch (CS, Raisamyl 50021 from Ciba Specialty Chemicals Ltd), of which degree of substitution (D.S.) ca 0.035, and charge density of ca. 0.2 meq/g was used to enhance the retention of the NFC on the fibres.

Nanofibrillar Cellulose

Different grades of modified NFC were used. The NFC was prepared from never dried birch pulp, obtained from UPM-Pietarsaari and grinded to SR 90. NFC samples were prepared either using the Masuko Mass Colloider (Masuko Sangyo Co., Kawaguchi, Japan) or the laboratory scale fluidizer (M-110Y, Microfluidics Corp.). As a reference a sample prepared by passing the pulp 5 times trough the Masuko colloider was used.

Electrolytes (NaCl and $NaHCO_3$) were of analytical grade and dissolved in deionized water. Analytical grade HCl and NaOH solutions were used for pH adjustments. The used water was deionized.

Methods

Sheet Forming

The pH and electrolyte concentration of the fibre suspension was kept constant using 1 mM $NaHCO_3$ and 9 mM NaCl. Polyelectrolyte (cationic starch or PDADMAC) was first added to the fibre suspension and the suspension was vigorously mixed for 15 min. The NFC was dispersed using ultrasound, added to polyelectrolyte treated pulp and the suspension was mixed for another 15 min. Sheets were formed in a laboratory sheet former, Lorentzen & Wettre AB, Sweden (ISO 5269-1) with a 100 mesh wire. The grammage of sheets was adjusted to about 60 g/m$^2$ by dilution of the suspension when necessary. The sheets were wet pressed under 4.2 bars for 4 minutes and dried in a frame to avoid shrinkage during drying (105° C. for 3 minutes). The samples were conditioned over nigh in 50% humidity and 20° C. according to the standard SCAN_P 2:75 before testing.

Sheet Testing

All the sheet properties were measured according to SCAN or ISO standards. Grammage (ISO 536:1995(E)), thickness and bulk were determined with Lorentzen & Wettre micrometer (ISO 534:2005(E)). The Scott Bond was determined using Huygen Internal bond tester) and Tensile strength, fracture toughness index and TEA were measured with Lorentzen & Wettre tearing tester (SEOO9 Elmendorf, SCAN-P 11:73).

Results

Strength of Sheets

In Tables 5 and 6 the sheet properties of sheets made using NFC prepared with Masuko supermass colloider (Table 5) or microfluidics fluidizer (Table 6) are summarized. Cationic starch, CS, Raisamyl 50021 was used in the experiments presented in table 5 and 6.

TABLE 5

Sheet properties of sheets made from pulp, cationic starch (CS, 25 mg/g)) and nanofibrillated cellulose (NFC, 30 mg/g). NFC was prepared with Masuko supermass colloider. Reference sample contains only pulp.

| NFC grade | Passes | Grammage ($g/m^2$) | Density ($kg/m^3$) | Tensile index (Nm/g) | Scott Bond ($J/m^2$) |
|---|---|---|---|---|---|
| Reference | No NFC | 60.8 | 558 | 58.35 | 132 |
| WRM sorption | 1 | 58 | 579 | 90.2 | 405 |
| WRM sorption | 3 | 58.3 | 599 | 84.16 | 531 |
| WRM sorption | 5 | 56.4 | 573 | 89.49 | 400 |
| WRM sorption + addition | 1 | 59 | 584 | 85.08 | 446 |
| WRM sorption + addition | 3 | 61.4 | 608 | 86.76 | 559 |
| BW sorption | 1 | 59 | 564 | 76.26 | 347 |
| BW sorption | 3 | 59.5 | 582 | 84.62 | 426 |
| BW sorption | 5 | 59.8 | 603 | 85.77 | 470 |

Abbreviations: WRM, high molecular weight CMC; BW, low molecular weight CMC

TABLE 6

Sheet properties of sheets made from pulp, cationic starch (CS, 25 mg/g)) and nanofibrillated cellulose (NFC, 30 mg/g). NFC was prepared with microfluidics fluidizer. Reference sample contains pulp, cationic starch (CS) and unmodified NFC.

| NFC grade | Passes | Grammage ($g/m^2$) | Density ($kg/m^3$) | Tensile index (Nm/g) | Scott Bond ($J/m^2$) |
|---|---|---|---|---|---|
| BW sorption | 4 | 62.4 | 575 | 79.26 | 383 |
| BW addition | 4 | 62.8 | 597 | 85.16 | 520 |
| WRM addition | 4 | 62.6 | 589 | 82.68 | 427 |
| WRM sorption | 4 | 62.8 | 592 | 79.91 | 520 |
| REF no CMC | 4 | 62.3 | 572 | 82.97 | 411 |
| BW sorption + addition | 2 | 65.1 | 589 | 74.21 | 480 |
| BW sorption + addition | 3 | 63.5 | 583 | 78.1 | 446 |
| BW sorption + addition | 4 | 66 | 608 | 84.59 | 517 |
| WRM sorption + addition | 2 | 62.9 | 574 | 84.63 | 380 |
| WRM sorption + addition | 3 | 62.6 | 593 | 82.65 | 434 |
| WRM sorption + addition | 4 | 63.3 | 608 | 83.1 | 561 |

Abbreviations: WRM, high molecular weight CMC; BW, low molecular weight CMC

In FIG. 5 both the way of preparing NFC and the effect of passes through the Fluidizer are compared. The corresponding microscopy images show that the fibril size is decreasing with the passes through the Fluidizer. No clear difference between Masuko and Fluidizer samples are found in this case. Compared to the reference at 132 $J/m^2$, the Scott Bond increases clearly and also compared to unmodified NFC (411 $J/m^2$ after 4 passes) CMC modified NFC gives higher Scott Bond.

The present invention has been described herein with reference to specific embodiments. It is, however clear to a person skilled in the art that the process(es) may be varied within the bounds of the claims.

The invention claimed is:

1. A method for producing modified nanofibrillated cellulose, comprising:

preparing a suspension containing fibers from cellulosic material;

adsorbing a cellulose derivative or polysaccharide or polysaccharide derivative onto the fibers in said suspension under special conditions; and subjecting the fiber suspension comprising said cellulose derivative or polysaccharide or polysaccharide derivative to mechanical disintegration;

to obtain modified nanofibrillated cellulose modified with said cellulose derivative or polysaccharide or polysaccharide derivative.

2. The method according to claim 1, wherein the cellulosic material is a pulp selected from the group consisting of a chemical pulp, mechanical pulp, thermo mechanical pulp and chemi-thermo mechanical pulp produced from wood, non-wood material or recycled fibers.

3. The method according to claim 2, wherein wood is from softwood tree, hardwood tree, or a mixture of softwoods and hardwoods.

4. The method according to claim 1, wherein the cellulose derivative is carboxymethyl cellulose.

5. The method according to claim 2, wherein the cellulose derivative or polysaccharide or polysaccharide derivative is adsorbed onto the fibers prior to or during mechanical disintegration.

6. The method according to claim 3, wherein the cellulose derivative or polysaccharide or polysaccharide derivative is adsorbed onto the fibers both prior to and during mechanical disintegration.

7. The method according to claim 1, wherein the cellulose derivative or polysaccharide or polysaccharide derivative is adsorbed onto the fibers at a temperature of at least 5° C. up to 180° C.

8. The method according to claim 1, wherein the cellulose derivative or polysaccharide or polysaccharide derivative is adsorbed onto the fibers at a temperature of 75° C.-80° C.

9. The method according to claim 1, wherein the cellulose derivative or polysaccharide or polysaccharide derivative is adsorbed onto the fibers for at least 1 minute.

10. The method according to claim 1, wherein the method takes place in the presence of monovalent or polyvalent cations.

11. The method according to claim 1, wherein the pH value of the fiber suspension is at least pH 2 up to pH 12.

12. The method according to claim 1, wherein the amount of added cellulose derivative or polysaccharide or polysaccharide derivative is at least 5 mg/g of fiber suspension up to 1000 mg/g of fiber suspension.

13. The method according to claim 1, wherein mechanical disintegration is carried out with a refiner, grinder, homogenizer, colloider, friction grinder, fluidizer such as microfluidizer, macrofluidizer or fluidizer-type homogenizer.

14. The method according to claim 1, wherein the fiber suspension is passed through mechanical disintegration at least once.

15. The method according to claim 1, wherein the fiber suspension containing the cellulose derivative or polysaccharide or polysaccharide derivative is redispersed in water to a concentration of at least 0.1% up to 10% prior to mechanical disintegration.

16. The method according to claim 1, comprising:

washing the fiber suspension comprising the cellulose derivative, polysaccharide or polysaccharide derivative with water prior to mechanical disintegration.

17. The method according to claim 16, comprising:

removing the water from the fiber suspension comprising the cellulose derivative, polysaccharide or polysaccharide derivative to form a moist pulp cake prior to mechanical disintegration.

18. The method according to claim 17, comprising:

redispersing the moist pulp cake in water prior to mechanical disintegration.

* * * * *